US008523717B1

(12) United States Patent
Haroldson

(10) Patent No.: US 8,523,717 B1
(45) Date of Patent: Sep. 3, 2013

(54) HUNTING ARROW HAVING A HOLE BORING HEAD

(76) Inventor: John Haroldson, Rosholt, WI (US)

( * ) Notice: Subject to any disclaimer, the term of this patent is extended or adjusted under 35 U.S.C. 154(b) by 0 days.

(21) Appl. No.: 13/418,409

(22) Filed: Mar. 13, 2012

(51) Int. Cl.
*F42B 6/08* (2006.01)

(52) U.S. Cl.
USPC ..... 473/583; 473/582

(58) Field of Classification Search
USPC ..... 473/578, 582, 583; 30/316
See application file for complete search history.

(56) References Cited

U.S. PATENT DOCUMENTS

| | | | | | |
|---|---|---|---|---|---|
| 64,891 | A * | 5/1867 | McFarland | 30/410 |
| 158,420 | A * | 1/1875 | Knapp | 30/113.1 |
| 1,371,948 | A * | 3/1921 | Szutz | 30/316 |
| 2,990,615 | A * | 7/1961 | Ohler | 30/316 |
| 3,993,311 | A * | 11/1976 | Johnson | 473/585 |
| 4,212,463 | A * | 7/1980 | Repinski et al. | 473/581 |
| 5,044,640 | A * | 9/1991 | DelMonte et al. | 473/584 |
| D342,303 | S * | 12/1993 | Johnson | D22/115 |
| D384,126 | S * | 9/1997 | Graham | D22/115 |
| 6,669,585 | B2 * | 12/2003 | Sutherland et al. | 473/581 |
| 6,863,630 | B1 * | 3/2005 | Watkins et al. | 473/583 |

* cited by examiner

*Primary Examiner* — John Ricci
(74) *Attorney, Agent, or Firm* — Kyle Fletcher

(57) ABSTRACT

The hunting arrow having a hole boring head includes an arrow shaft that attaches an arrowhead comprised of points that are notched into the head such that the arrowhead and at least a portion of the arrow shaft have an open hole in the center in order to cut a hole through the skin and flesh of game for unimpeded blood loss therefrom. The points constructed of notches are concentrically, arranged, and require at lease a portion of the arrow shaft to be hollowed such that the open hole extends rearwardly with respect to the shaft. The hunting arrow may include a plurality of external blades that extend radially from the exterior surface of the arrowhead, and may be centered about each of the points.

19 Claims, 9 Drawing Sheets

HUNTING ARROW HAVING A HOLE BORING HEAD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hunting arrows, more specifically, a hunting arrow in which the head has an open boring head.

B. Discussion of the Prior Art

As a preliminary note, it should be stated that there is an ample amount of prior art that deals with hunting arrows, generally. As will be discussed immediately below, no prior art discloses a tip of a hunting arrow that includes a hole about the center, which cuts a hole into the skin and flesh of game in order to enable unimpeded blood loss therefrom; wherein the hole is formed from a plurality of points that are notched into the front of the arrowhead such that at least a portion of the arrow shaft is hollow; wherein the hole of the tip of the arrow extends rearwardly for at least a portion of the arrow shaft; wherein the arrowhead may include a plurality of external blades that extend radially from the exterior surface of the arrow shaft; wherein a ballistic tip is included and covers the arrowhead during flight to account for aerodynamics, and which is cut away upon impact with the target.

The Delmonte et al. Patent (U.S. Pat. No. 5,044,640) discloses an arrow broadhead tip having a plurality of razor sharp blades to cleanly cut a hole into an animal proving means for the animal to profusely bleed to death unimpeded by loos skin or hide closing the hole. However, the arrow broadhead tip does not have an open design such that the center of the arrow tip is an open hole that extends rearwardly through at least a portion of the arrow shaft such that upon impact with game, a hole is bored through the skin and flesh in order to maximize blood loss therefrom.

The Sutherland et al. Patent (U.S. Pat. No. 6,669,585) discloses a hunting arrow having a hollow cylindrical shaft. However, the hunting arrow does not include an arrow head in which the tip is a hollowed hole that extends rearwardly through at least a portion of the shaft and which forms a hole in the flesh of game, which unimpedes blood loss therefrom.

The Repinski et al. Patent (U.S. Pat. No. 4,212,463) discloses a hunting arrow designed to obtain the most bleed-out possible comprising a hollow shaft. However, the hunting arrow features an arrow tip that is not a hole formed about the center of said tip and which cuts a hole into the skin and flesh of game thereby unimpeding blood loss.

The Johnson Patent (U.S. Pat. No. 3,993,311) discloses a hunting arrow that will cause massive bleed in wounded game having a hollow shaft. However, the hunting arrow does not have an arrow tip with an open holed center that cuts a hole through both the skin and game of game upon impact, which produces unimpeded blood loss therefrom.

The Watkins et al. Patent (U.S. Pat. No. 6,863,630) discloses a hunting arrow having a cutting ring to promote bleeding of hunted game. Again, the cutting ring of the hunting arrow is not an arrow tip having a hole thereon, which extends rearwardly through at least a portion of the arrow shaft and upon impact shall bore a hole through the skin and flesh of game thereby producing unimpeded blood loss.

The Graham Patent (U.S. Pat. No. Des. 384,126) illustrates a design for a broadhead, which does not resemble an open arrow tip.

The Johnson Patent (U.S. Pat. No. Des. 342,303) illustrates an ornamental design for a broadhead. Again, the tip of the broadhead includes lateral members that do not form a truly open hole across the center of the tip of the arrow head.

While the above-described devices fulfill their respective and particular objects and requirements, they do not describe a tip of a hunting arrow that includes a hole about the center, which cuts a hole into the skin and flesh of game in order to enable unimpeded blood loss therefrom; wherein the hole is formed from a plurality of points that are notched into the shaft of the arrowhead such that at least a portion of the arrow shaft is hollow; wherein the hole of the tip of the arrow extends rearwardly for at least a portion of the arrow shaft; wherein the arrowhead may include a plurality of external blades that extend radially from the exterior surface of the arrow shaft; wherein a ballistic tip is included and covers the arrowhead during flight to account for aerodynamics, and which breaks away upon impact with the target. In this regard, the hunting arrow having a hole boring head departs from the conventional concepts and designs of the prior art.

SUMMARY OF THE INVENTION

The hunting arrow having a hole boring head includes an arrow shaft that attaches an arrowhead comprised of points that are notched into the head such that the arrowhead and at least a portion of the arrow shaft have an open hole in the center in order to cut a hole through the skin and flesh of game for unimpeded blood loss therefrom. The points constructed of notches are concentrically arranged, and require at lease a portion of the arrow shaft to be hollowed such that the open hole extends rearwardly with respect to the shaft. The hunting arrow may include a plurality of external blades that extend radially from the exterior surface of the arrowhead, and may be centered about each of the points. A ballistic tip is included and covers the arrowhead during flight to account fox aerodynamics, and which is cut through itself and breaks apart upon impact with the target, after which the arrowhead cuts through said target.

An object of the invention is to provide a tip of a hunting arrow that is formed of points notched into the arrowhead such that a centrally aligned hole is formed and which cuts a hole through the skin and flesh of game, which produces an inlet hole, a core hole, and an exit hole that does not impede blood loss therefrom.

A further object of the invention is to provide an arrowhead having a hole boring head therein, which is attached to the arrow shaft, and which forms the points via the notches on the arrowhead.

An even further object of the invention is to have a hole boring head that extends rearwardly through the arrowhead and at least a portion of the arrow shaft.

A further object of the invention is to provide external blades that extend radially from the exterior of the arrow shaft.

An even further object of the invention is to provide external blades that align with the points forming the arrowhead.

A further object of the invention is to provide a nock that attaches to the aft end of the arrow shaft, and which is detachably engaged therein.

Another object of the invention is to include a ballistic tip that attaches over the arrowhead, and which is cut through and breaks apart upon impact with the target, and thereafter enables the arrowhead to cut through said target.

These together with additional objects, features and advantages of the hunting arrow having a hole boring head will be readily apparent to those of ordinary skill in the art upon reading the following detailed description of presently preferred, but nonetheless illustrative, embodiments of the hunting arrow having a hole boring head when taken in conjunction with the accompanying drawings.

In this respect, before explaining the current embodiments of the hunting arrow having a hole boring head in detail, it is to be understood that the hunting arrow having a hole boring head is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hunting arrow having a hole boring head.

It is therefore important that the claims be regarded as including such equivalent construction insofar as they do not depart from the spirit and scope of the hunting arrow having a hole boring head. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
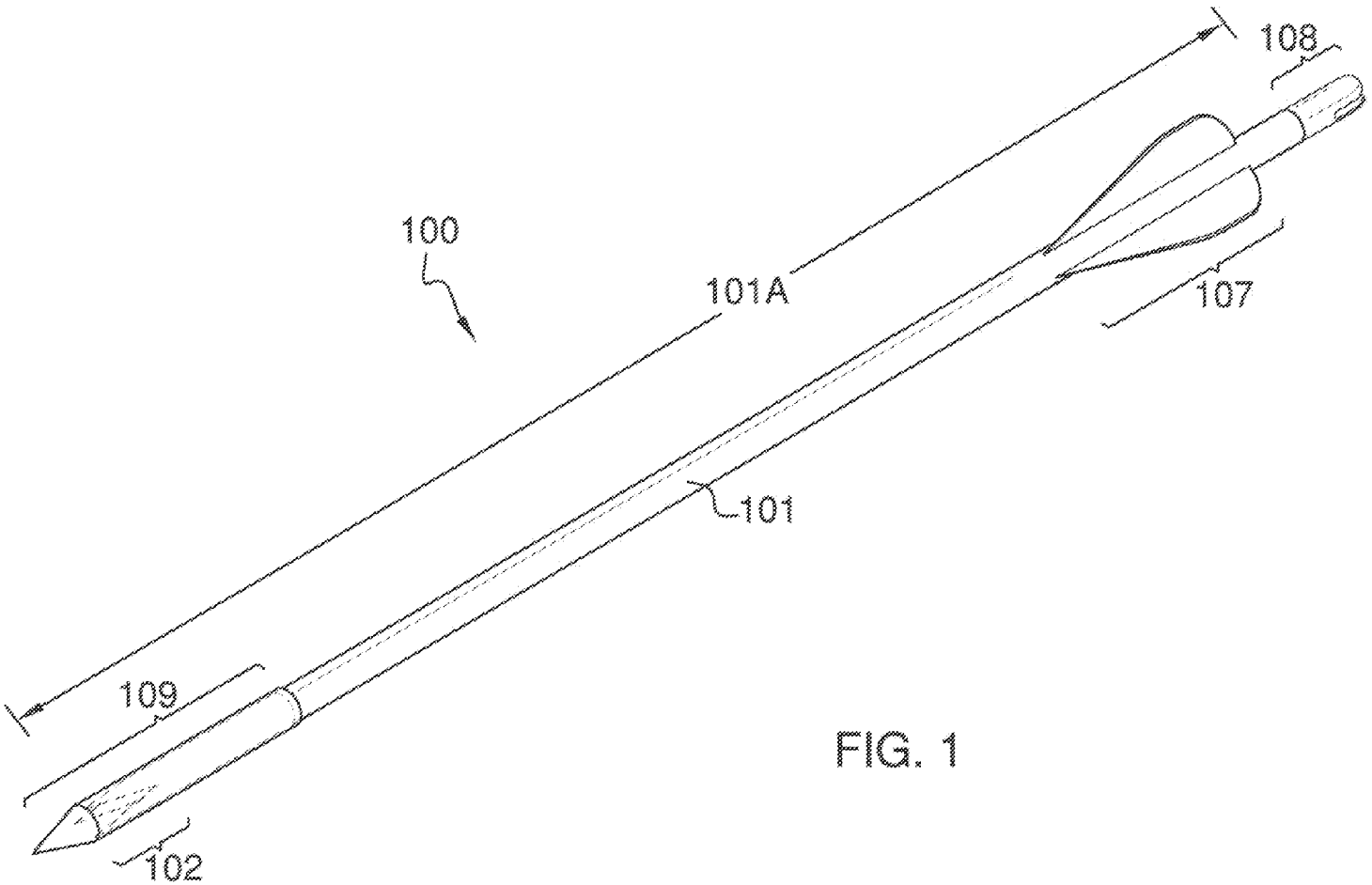
FIG. 1 illustrates a perspective view of the hunting arrow having a hole boring head by itself, in which the arrowhead and hole are formed of three points, and are covered by the ballistic tip.
Figure 2:
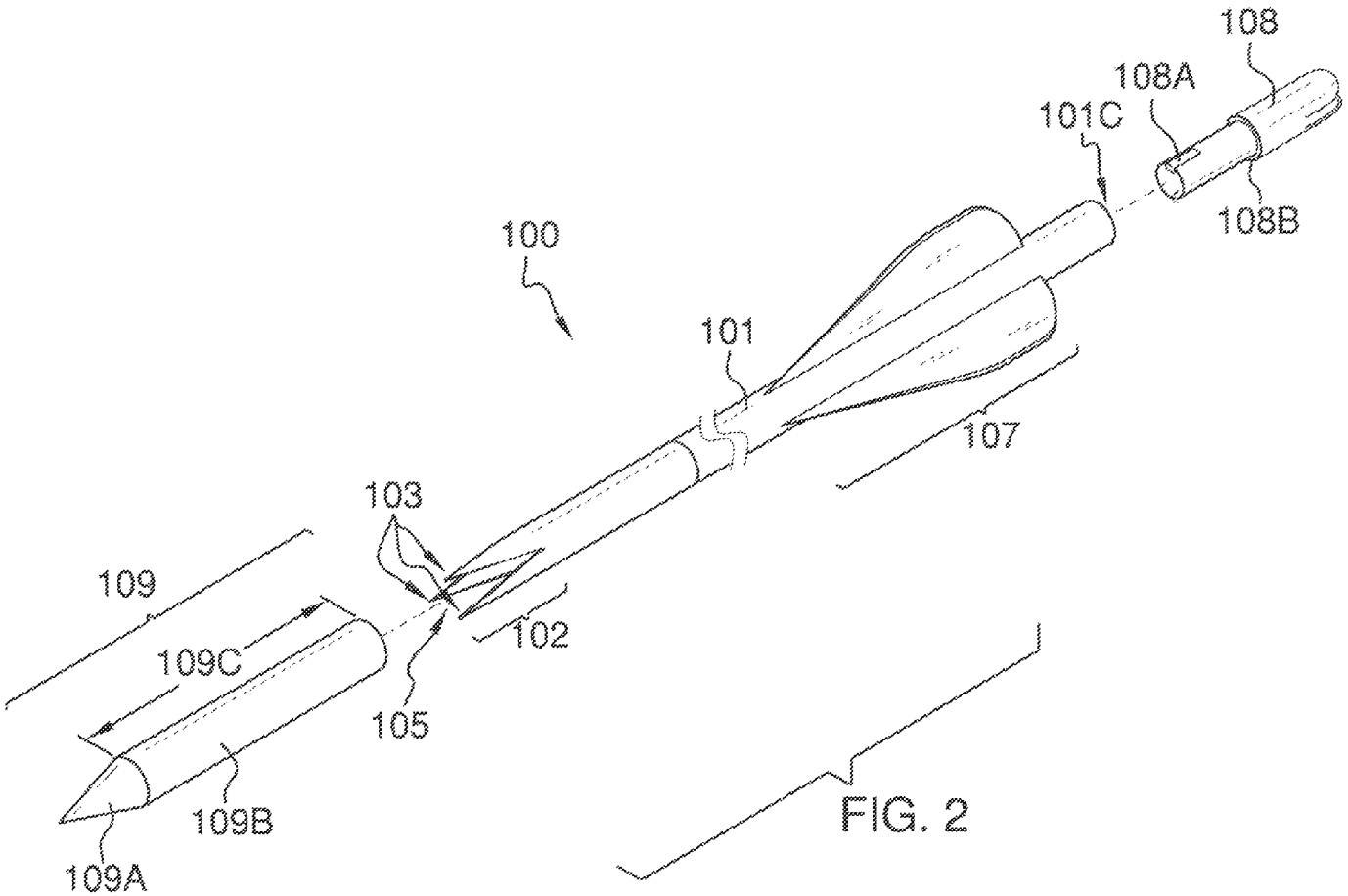
FIG. 2 illustrates an exploded view of the hunting arrow having a hole boring head in which the nock and ballistic tip are disconnected from the respective portions of the arrow shaft.
Figure 3:
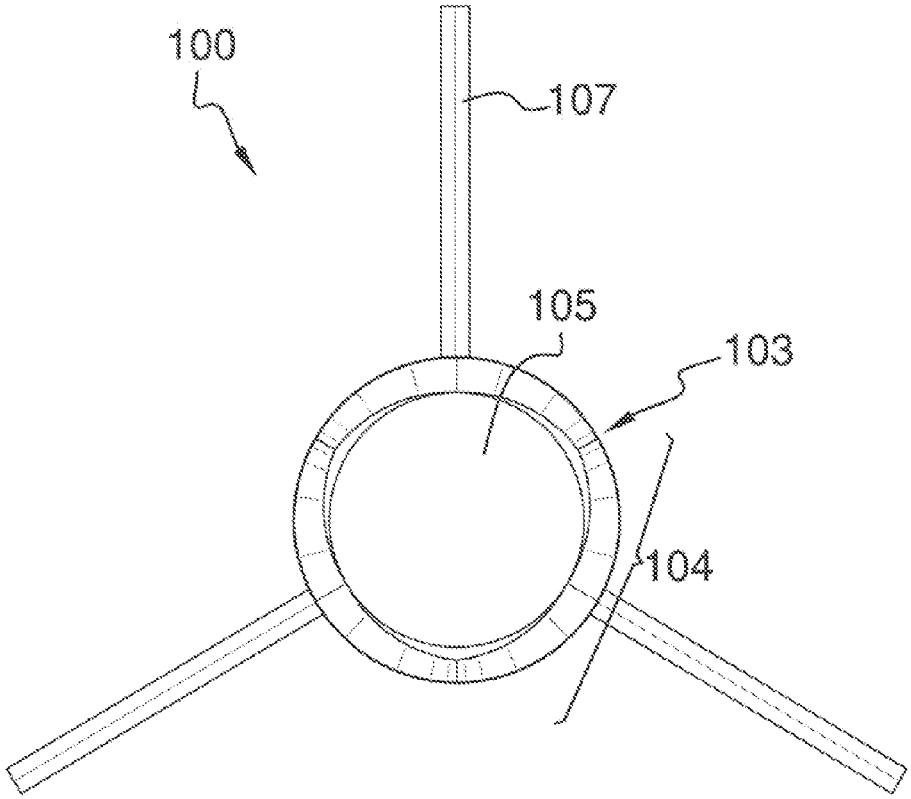
FIG. 3 illustrates a front view of the hunting arrow having a hole boring head in which a detail is provided as to the hole of the arrowhead extending through an entirety of the hollow shaft.
Figure 4A:
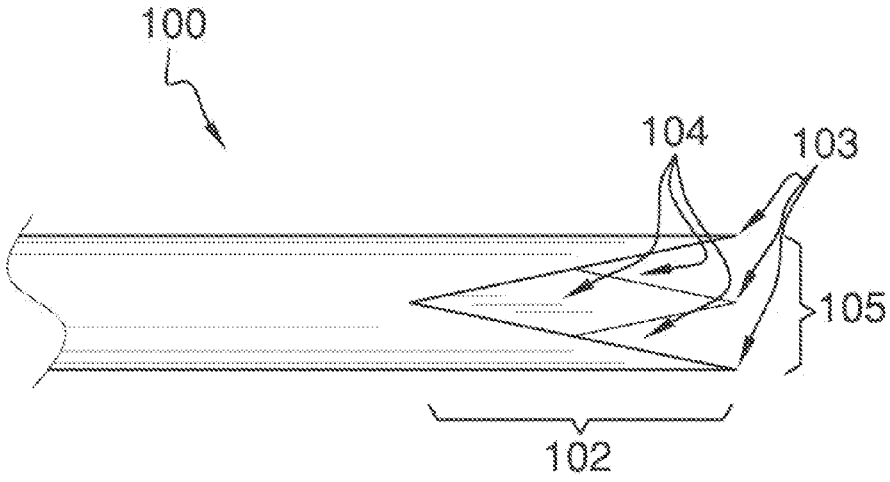
FIG. 4A illustrates a side view of the arrowhead portion of the arrow in which three points are formed from three notches.
Figure 5A:
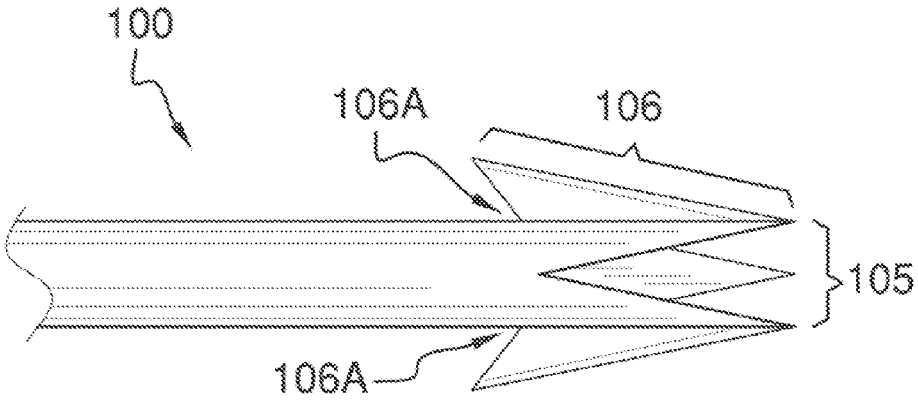
FIG. 5A illustrates a side view of an alternative embodiment in which external blades are arranged and aligned with the three points forming the arrowhead.
Figure 4B:
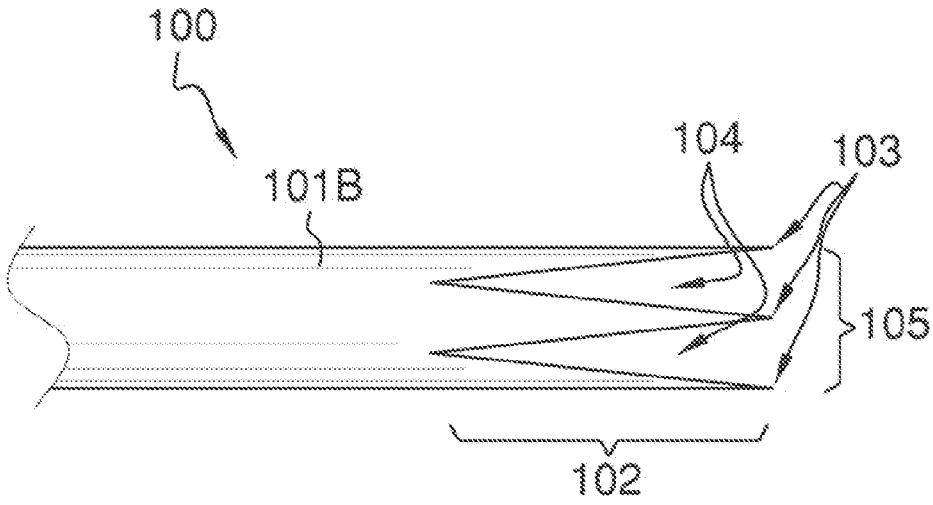
FIG. 4B illustrates a side view of the arrowhead portion of the arrow in which four points are formed from four notches.
Figure 5B:
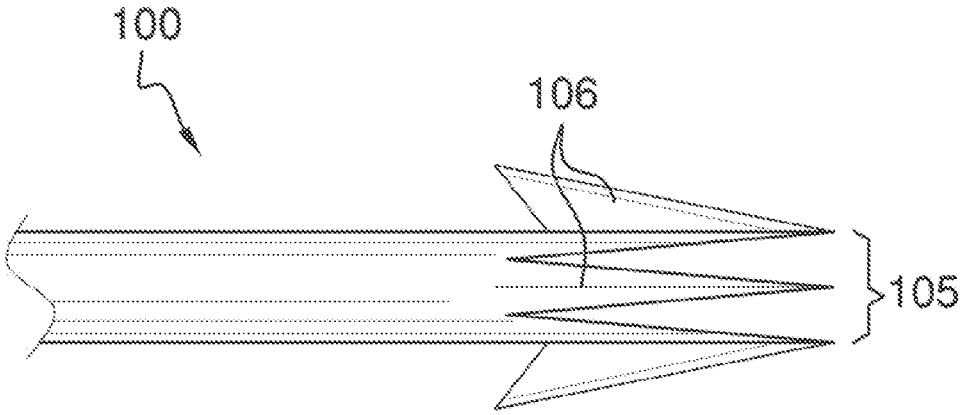
FIG. 5B illustrates a side view of an alternative embodiment in which external blades are arranged and aligned with the four points forming the arrowhead.
Figure 4C:
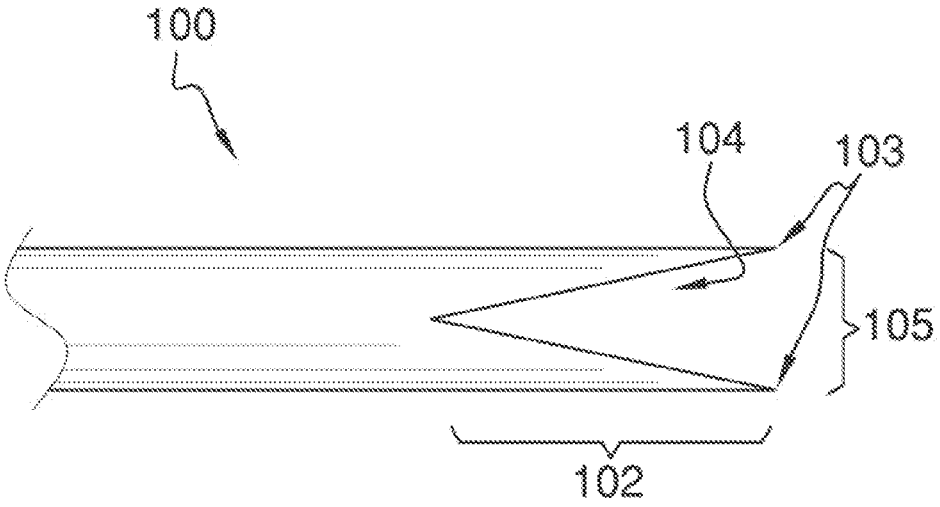
FIG. 4C illustrates a side view of the arrowhead portion of the arrow in which two points are formed from two notches.
Figure 5C:
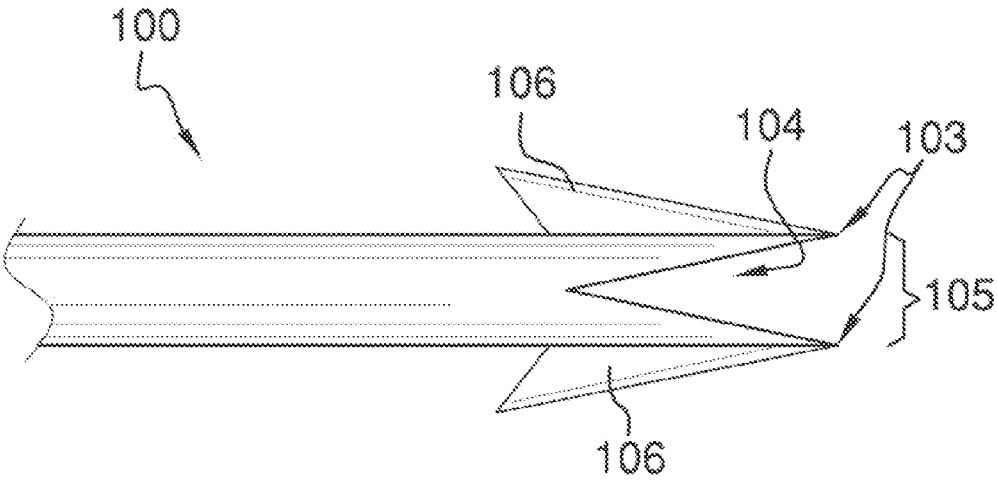
FIG. 5C illustrates a side view of an alternative embodiment in which external blades are arranged and aligned with the two points forming the arrowhead.
Figure 4D:
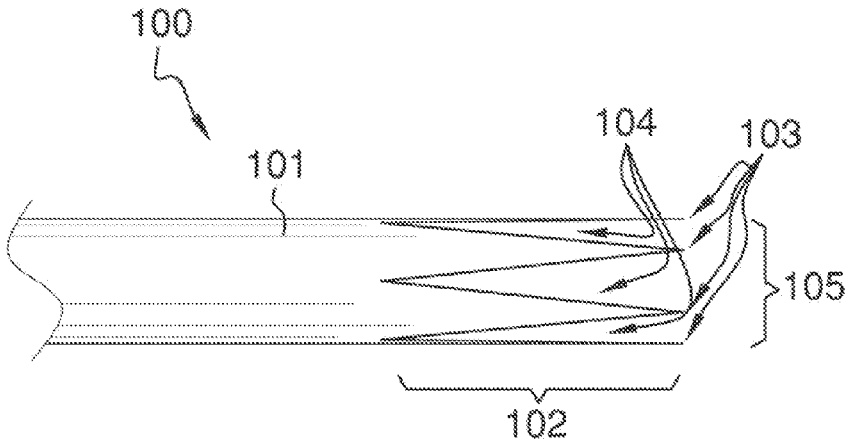
FIG. 4D illustrates a side view of the arrowhead portion of the arrow in which six points are formed from six notches.
Figure 5D:
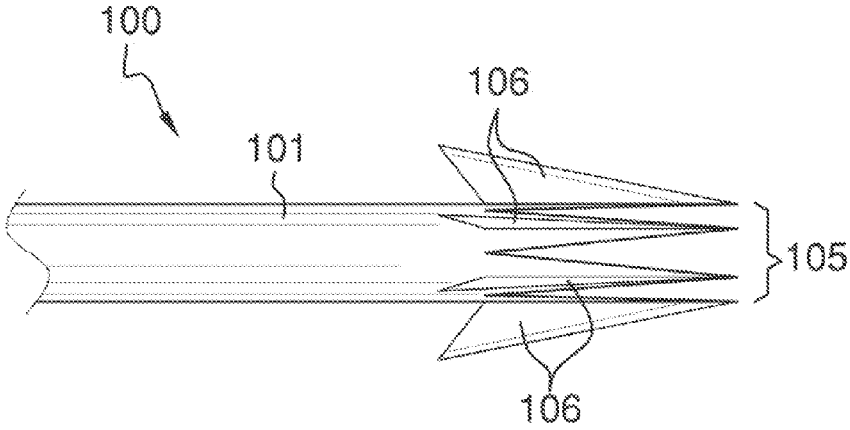
FIG. 5D illustrates a side view of an alternative embodiment in which external blades are arranged and aligned with the six points forming the arrowhead.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6B. A hunting arrow having a hole boring head 100 (hereinafter invention) includes an arrow shaft 101 defining an arrowhead 102 at a forward most end of the arrow shaft 101. Located at the arrowhead 102 are a plurality of points 103 formed via notches 104, which are cut into the arrowhead 102:. Both the notches 104 and the points 103 are concentrically aligned about a hollowed arrow shaft 101 such that a boring hole 105 (hereinafter hole) is formed therein. It shall be noted that the formation of the boring hole 105 is the genesis behind the invention 100 in that upon impact of the arrowhead 102 into game 130, a disc-shaped plug 130A is cut from the skin and flesh of the game 130, and an inlet hole 131, an outlet hole 132, and a core hole 133 results into the skin and flesh of the game 130, which cannot close up and thereby assists in unimpeded blood loss 140 (see FIG. 6A). It shall be noted that the term corn hole 133 is being used to indicate a channel spanning between the inlet hole 131 and the outlet hole 132.

It shall be noted that the force of impact of the arrowhead 102 into the game 130 shall simultaneously cut out the disc-shaped plug 130A, which travels into the arrow shaft 101 and exits from the game 130 within the invention 100. It shall be noted that the invention 100 forms the inlet hole 131, the outlet hole 132, and the core hole 133, which collectively are incapable of sealing shut. Moreover, the invention 100 ideally travels entirely through the game 130, and from which blood 140 exits.

It shall be noted that the arrow shaft 101 does not have to be hollowed along a length 101A. Rather, the arrow shaft 101 shall be hollow for at least a portion of the arrow shaft 101 in order to accommodate the disc-shaped plug 130A as well as insertion of the arrowhead 102. Please note that the arrow shaft 101 is likely hollowed through the entire length 101A, in order to promote proper functionality of the invention 100 during flight, and that less than the entire length 101A is being hereby asserted as a possible embodiment of use of the invention 100.

It shall be further noted that both the points 103 and notches 104 are concentrically arranged around the arrow shaft 101. Moreover, the points 103 and notches 104 shall have a sharpened edge that further aids in penetration of the arrowhead 102 into the skin and flesh of game 130.

In referring to FIGS. 4A-4D, the invention 100 may employ at least two points 103. FIGS. 4A-4D depict multiple numbers of points 103 ranging from two to six. However, it shall be noted that other number of points 103 and notches 104 may be employed so long as the arrangement is concentrically aligned about the arrow shaft 101.

It shall be further noted that the term "concentrically aligned" is being used to indicate that the points 103 and the respective notches 104 are symmetrically offset from one another around the arrow shaft 101. The use of the term "concentrically aligned" is important in order for the invention 100 to operate effectively, aerodynamically speaking.

Referring to FIGS. 5A-5D, the invention 100 may include external blades 106 that extend radially from an exterior surface 101B of the arrow shaft 101. Moreover, the external blades 106 align with and equal to the number of points 103 of the respective embodiment of the invention 100. It shall be noted that the alignment of the external blades 106 is also important to the aerodynamic function of the invention 100. The external blades 106 include a sharpened edge 106A, which are angled back towards the arrow shaft 101, and which produces a V-shape or angle to catch on brush in the event that the arrowhead 102 travels through the game 130, but the entire invention 100 does not pass completely through the game 130. In said event, the sharpened edge 106A of the external blades 106 shall engage on brush in order to pull the invention 100 entirely through said game 130 for the purpose of securing unimpeded blood flow from both the inlet hole 131 and the outlet hole 132.

It shall be noted that the invention 100 includes fletchings 107 that are arranged at the rear end of the arrow shaft 101, and are well known in the prior art. Moreover, the invention 100 includes a nock 108 that is detachably engaged with respect to the rear shaft hole 101C. The nock 108 is slideably engaged within the rear shaft hole 101C, and may include a magnet 108A for temporary attachment thereto. The magnet 108A shall work in conjunction with the arrow shaft 101, which is constructed of a magnetic or ferrous material in order to accommodate magnetic attraction there with. The nock 108 may include a shoulder 108B to limit the amount of travel into the rear shaft hole 101C.

It should be noted that the nock 108 will have a snug fit with the arrow shaft 101, and may not require magnetic attraction there between. Moreover, the nock 108 would simply disconnect from the arrow shaft 101 upon impact with the game 130 during which air pressure shall increase due to the disc-shaped plug 130A traveling inside of the arrow shaft 101, and which would expel the nock 108 from the arrow shaft 101.

The invention 100 may include a ballistic tip 109 that attaches onto the invention 100. Moreover, the ballistic tip 109 fits over the arrowhead 102, and upon impact with the game 130 shall be cut through itself and break apart. The ballistic tip 109 shall be construction of a material that is relatively weak in comparison with the material comprising the arrowhead 102. The ballistic tip 109 is designed to enable aerodynamic flow across the invention 100 during flight, and upon impact with the game 130, the ballistic tip 109 shall cut through itself and break apart.

Figure 6A:
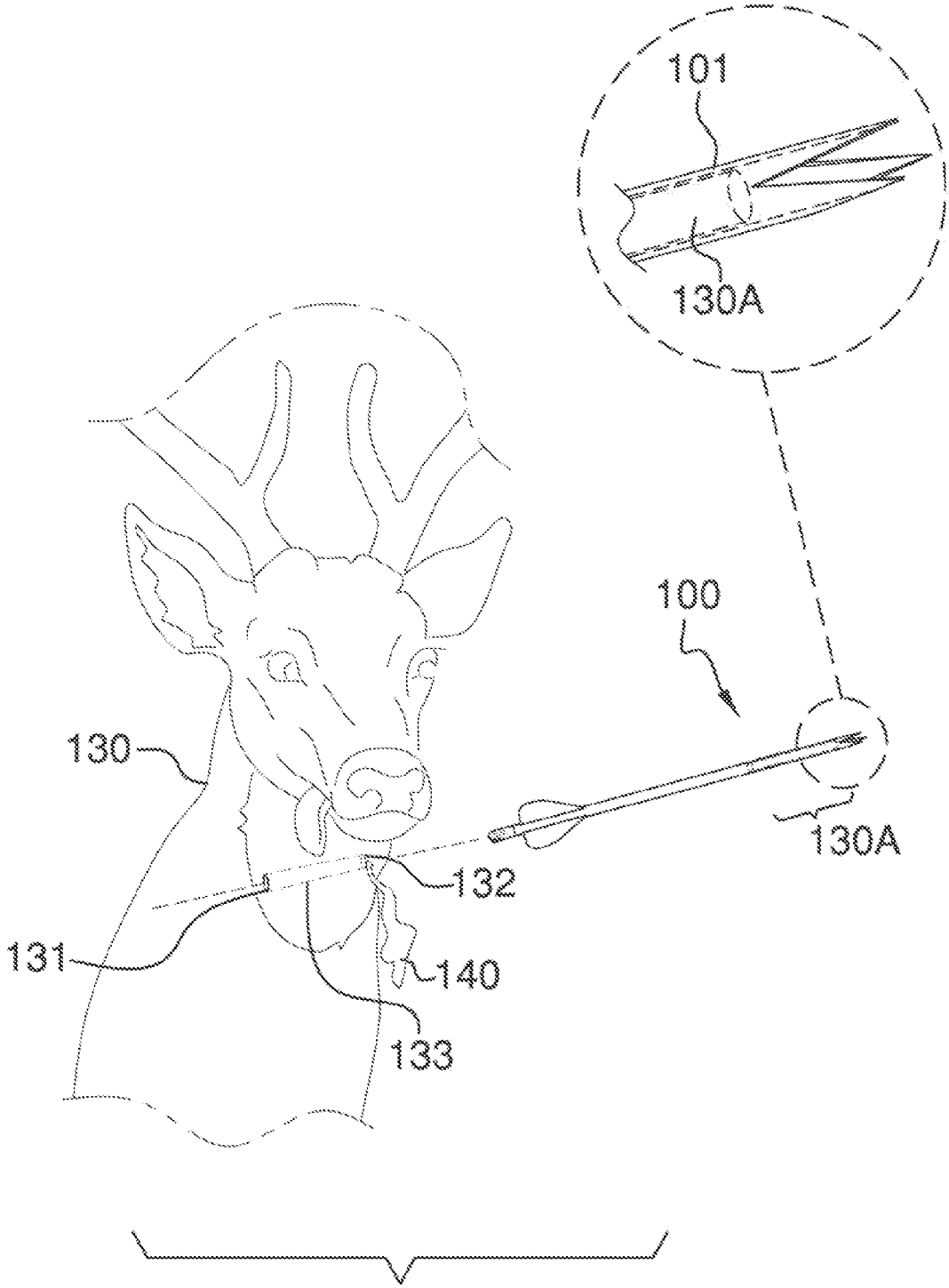
FIG. 6A illustrates a view in which the arrowhead and arrow shaft have passed through game, in which the arrowhead forms an inlet hole and an outlet hole in the game, and from which results unimpeded blood loss.
Figure 6B:
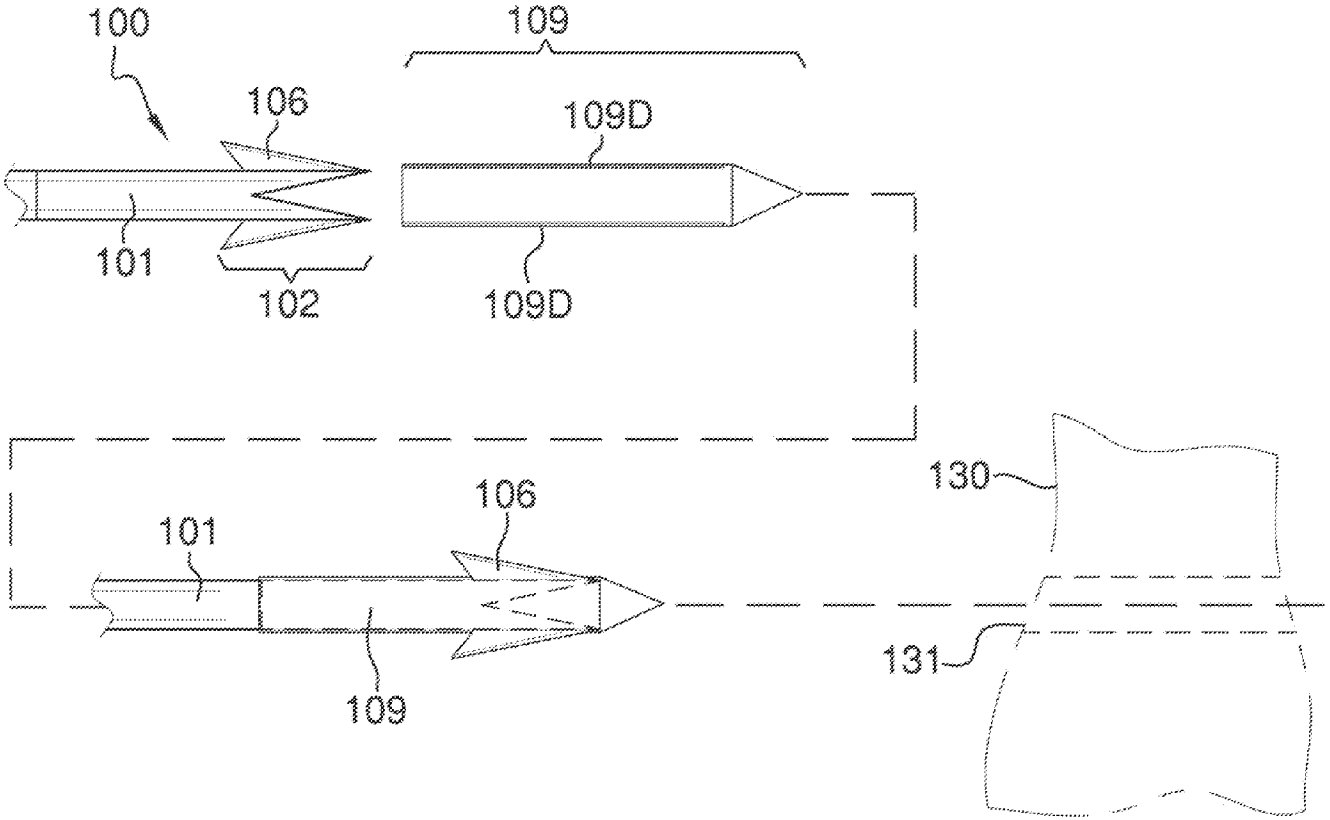
FIG. 6B is an exploded view of the ballistic tip modified with notches to accommodate an arrowhead embodiment that includes external blades, and in which the ballistic tip shall cut through itself and breaks apart upon impact after which the arrowhead and the external blades form an inlet hole, a core hole, and an outlet hole through the game.

The ballistic tip 109 includes a cone portion 109A seated onto a shoulder 109B that has a length 109C greater than the arrowhead 102. Referring to FIG. 6B, the ballistic tip 109 may include slots 109D, which accommodate the external blades 106 of the embodiments of FIGS. 5A-5D. The slots 109D may be provided on the shoulder 109B portion of the ballistic tip 109. The slots 109D shall be arranged and aligned according to the spacing and placement of the external blades 106. Moreover, the slots 109D improve the ability of the ballistic tip 109 to cut through itself and break apart from the arrowhead 102 during impact with the game 130.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hunting arrow having a hole boring head comprising:

an arrow shaft at least partially of hollow construction and attached to an arrowhead at a forward most end of said arrow shaft;

wherein a plurality of points are individually formed via notches thereby creating a boring hole thereon, and which shall cut a disc-shaped plug from skin and flesh of game upon impact of said arrowhead thereon, and which shall remain inside of the arrow shaft;

wherein the arrowhead and arrow shaft shall pass entirely through said game forming an inlet hole, a core hole, and an outlet hole incapable of sealing close, and from which blood exists in an unimpeded fashion;

wherein external blades extend radially from an exterior surface of the arrowhead.

2. The hunting arrow having a hole boring head as described in claim 1 wherein the notches have a sharpened edge.

3. The hunting arrow having a hole boring head as described in claim 1 wherein the hole extends rearwardly from the arrowhead along at least a portion of the arrow shaft.

4. The hunting arrow having a hole boring head as described in claim 1 wherein both the notches and the points are concentrically aligned around the arrowhead.

5. The hunting arrow having a hole boring head as described in claim 1 wherein the external blades align with and equal to the number of points of the respective arrowhead.

6. The hunting arrow having a hole boring head as described in claim 1 wherein a nock is detachably engaged with respect to a rear shaft hole of said arrow shaft.

7. The hunting arrow having a hole boring head as described in claim 6 wherein the nook is slideably engaged within the rear shaft hole.

8. The hunting arrow having a hole boring head as described in claim 7 wherein the nock includes a shoulder limiting the amount of travel into the rear shaft hole of the arrow shaft.

9. The hunting arrow having a hole boring head as described in claim 1 wherein a ballistic cap attaches over the arrowhead, and is cut itself into pieces that break apart during impact with the game, and after which the arrow head cuts through the game forming the disc-shaped plug, and exits therefrom.

10. The hunting arrow having a hole boring head as described in claim 9 wherein the ballistic tip is further defined with a cone portion seated onto a shoulder that has a length greater than the arrowhead.

11. The hunting arrow having a hole boring head as described in claim 10 wherein the ballistic tip includes slots provided on the shoulder, which are aligned and arranged with the external blades.

12. A hunting arrow having a hole boring head comprising:

an arrow shaft at least partially of hollow construction and attached to an arrowhead at a forward most end of said arrow shaft;

wherein a plurality of points are individually formed via notches thereby creating a boring hole thereon, and which shall cut a disc-shaped plug from skin and flesh of game upon impact of said arrowhead thereon, and which shall remain inside of the arrow shaft;

wherein the arrowhead and arrow shaft shall pass entirely through said game forming an inlet hole, a core hole, and an outlet hole incapable of sealing close, and from which blood exits in an unimpeded fashion;

wherein a ballistic cap attaches over the arrowhead, and cuts into pieces that break apart during impact with the game, and after which the arrowhead cuts through the game forming the disc-shaped plug, and exits therefrom.

13. The hunting arrow having a hole boring head as described in claim 12 wherein the notches have a sharpened edge.

14. The hunting arrow having a hole boring head as described in claim 12 wherein the hole extends rearwardly from the arrowhead along at least a portion of the arrow shaft.

15. The hunting arrow having a hole baring head as described in claim 12 wherein both the notches and the points are concentrically aligned around the arrowhead.

16. The hunting arrow having a hole boring head as described in claim 12 wherein external blades extend radially from an exterior surface of the arrowhead.

17. The hunting arrow having a hole boring head as described in claim 16 wherein the external blades align with and equal to the number of points of the respective arrowhead.

18. The hunting arrow having a hole boring head as described in claim 16 wherein the ballistic tip includes slots provided on the shoulder, which are aligned and arranged with the external blades.

19. The hunting arrow having a hole boring head as described in claim 12 wherein the ballistic tip is further defined with a cone portion seated onto a shoulder that has a length greater than the arrowhead.

* * * * *